US010465695B2

(12) United States Patent
Patel et al.

(10) Patent No.: US 10,465,695 B2
(45) Date of Patent: Nov. 5, 2019

(54) THRUST WASHER AND DIFFUSER FOR USE IN A DOWNHOLE ELECTRICAL SUBMERSIBLE PUMP

(71) Applicant: Halliburton Energy Services, Inc., Houston, TX (US)

(72) Inventors: Mitul Patel, Sugar Land, TX (US); Dezhi Zheng, Spring, TX (US); Mark Woodmansee, Houston, TX (US); Mark Marcos Pina, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 309 days.

(21) Appl. No.: 15/329,159

(22) PCT Filed: Aug. 26, 2014

(86) PCT No.: PCT/US2014/052695
§ 371 (c)(1),
(2) Date: Jan. 25, 2017

(87) PCT Pub. No.: WO2016/032439
PCT Pub. Date: Mar. 3, 2016

(65) Prior Publication Data
US 2017/0211582 A1 Jul. 27, 2017

(51) Int. Cl.
*F04D 29/22* (2006.01)
*F04D 13/10* (2006.01)
(Continued)

(52) U.S. Cl.
CPC ..... *F04D 29/2266* (2013.01); *E21B 43/128* (2013.01); *F04D 1/06* (2013.01);
(Continued)

(58) Field of Classification Search
CPC ..... F04D 29/2266; F04D 1/06; F04D 29/44; F04D 29/669; F04D 29/0416; F04D 13/10; E21B 43/128
(Continued)

(56) References Cited

U.S. PATENT DOCUMENTS 4,838,758 A * 6/1989 Sheth ..... F04D 13/10 415/140
4,872,808 A * 10/1989 Wilson ..... F04D 13/10 415/170.1
(Continued)

FOREIGN PATENT DOCUMENTS

CA 1148188 6/1983
CN 2737990 11/2005

OTHER PUBLICATIONS

Extended European Search Report for European Patent Application No. 14900965.6, dated Oct. 9, 2017; 7 pages.
(Continued)

*Primary Examiner* — J. Todd Newton
(74) *Attorney, Agent, or Firm* — Baker Botts L.L.P.

(57) ABSTRACT

In accordance with some embodiments of the present disclosure, a thrust washer and a diffuser for use in a downhole electrical submersible pump are disclosed. The pump may include a shaft and a motor communicatively coupled to the shaft. The motor may be operable to rotate the shaft. The pump may further include an impeller coupled to the shaft. The impeller may contain a balance ring, a balance hole, and a hub. The pump may further include a diffuser disposed adjacent to the impeller. The pump may further include a thrust washer coupled to the impeller. The thrust washer may be located between the balance ring and the hub without blocking the balance hole to allow fluid flow through the impeller and the diffuser. The pump may further include a
(Continued)

discharge operable to direct fluid flow out of the multi-stage electrical submersible pump.

26 Claims, 8 Drawing Sheets

(51) Int. Cl.

| | |
|---|---|
| ***F04D 1/06*** | (2006.01) |
| ***F04D 29/44*** | (2006.01) |
| ***E21B 43/12*** | (2006.01) |
| ***F04D 29/041*** | (2006.01) |
| ***F04D 29/66*** | (2006.01) |

(52) U.S. Cl.
CPC ..... *F04D 13/10* (2013.01); *F04D 29/0416* (2013.01); *F04D 29/44* (2013.01); *F04D 29/669* (2013.01)

(58) Field of Classification Search
USPC ..... 415/170.1
See application file for complete search history.

(56) References Cited

U.S. PATENT DOCUMENTS

| | | | | |
|---|---|---|---|---|
| 5,660,520 | A * | 8/1997 | Scarsdale | E21B 43/128 415/104 |
| 5,722,812 | A * | 3/1998 | Knox | F04D 1/06 415/199.1 |
| 6,106,224 | A * | 8/2000 | Sheth | F04D 29/0413 415/104 |
| 8,568,081 | B2 | 10/2013 | Song et al. | |
| 2004/0091352 | A1 * | 5/2004 | Gay | F04D 1/063 415/104 |
| 2016/0090992 | A1 * | 3/2016 | Jayaram | F04D 29/2238 415/144 |

OTHER PUBLICATIONS

International Search Report and Written Opinion, Application No. PCT/US2014/052695; 14 pgs., dated May 1, 2015.

* cited by examiner

THRUST WASHER AND DIFFUSER FOR USE IN A DOWNHOLE ELECTRICAL SUBMERSIBLE PUMP

RELATED APPLICATIONS

This application is a U.S. National Stage Application of International Application No. PCT/US2014/052695 filed Aug. 26, 2014, which designates the United States, and which is incorporated herein by reference in its entirety.

TECHNICAL FIELD

The present disclosure relates generally to well drilling and hydrocarbon recovery operations and, more particularly, to a thrust washer and a diffuser for use in a downhole electrical submersible pump.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as drilling a wellbore at a desired well site, treating the wellbore to optimize production of hydrocarbons, performing the necessary steps to produce the hydrocarbons from the subterranean formation, and pumping the hydrocarbons to the surface of the earth.

When performing subterranean operations, electrical submersible pumps (ESPs) may be used when reservoir pressure alone is insufficient to produce hydrocarbons from a well. ESPs may be installed on the end of a tubing string and inserted into a completed wellbore below the level of the hydrocarbon reservoir. An ESP may employ a centrifugal pump driven by an electric motor to draw reservoir fluids into the pump and to the surface.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

The present disclosure describes a thrust washer and diffuser for use in a downhole electrical submersible pump (ESP). Modern petroleum production operations use ESPs to pump hydrocarbons from a reservoir to the well surface when the pressure in the reservoir is insufficient to force the hydrocarbons to the well surface. An ESP may include one or more stages, each stage containing an impeller and a diffuser. The impeller and diffuser combinations may increase the velocity and pressure of the hydrocarbon fluid as the fluid travels through the stages of the ESP. The impeller may accelerate the fluid to increase the velocity and kinetic energy of the fluid. The diffuser may transform the kinetic energy of the fluid into potential energy by increasing the pressure of the fluid. In some embodiments, the ESP may be designed such that the impeller and the diffuser are not in contact during normal operating conditions. However at times, such when the actual flow rate is higher than the designed flow rate, the impeller may contact the diffuser located above the impeller. In other embodiments, the impeller may be designed to be in contact with a diffuser during normal operation. To avoid direct contact between the impeller and the diffuser, the ESP may include a thrust washer located between the impeller and the diffuser to prevent wear on the impeller or the diffuser caused by direct contact between the components. The thrust washer may be designed to have a large surface area, covering a majority of the contact area between the impeller and the diffuser, to distribute the frictional forces caused by the impeller and/or diffuser and reduce the wear of the thrust washer. Additionally, the thrust washer and the diffuser may be designed to create a seal to increase the pressure of fluid, such as oil or water, as the fluid travels through the diffuser. The pressure increase may return an impeller to a normal operating position where the impeller is not in contact with the diffuser. The use of a thrust washer designed in accordance with the present disclosure may allow an operating envelope of the ESP to increase. For example, the operating envelope of the ESP may increase from a maximum operating range of approximately 1000 barrels per day to a maximum operating range of approximately 1200 barrels per day. The maximum operating range increase may be caused by the ability of the ESP to maintain normal operating conditions. Embodiments of the present disclosure and its advantages are best understood by referring to FIGS. 1 through 7B, where like numbers are used to indicate like and corresponding parts.

Figure 1:
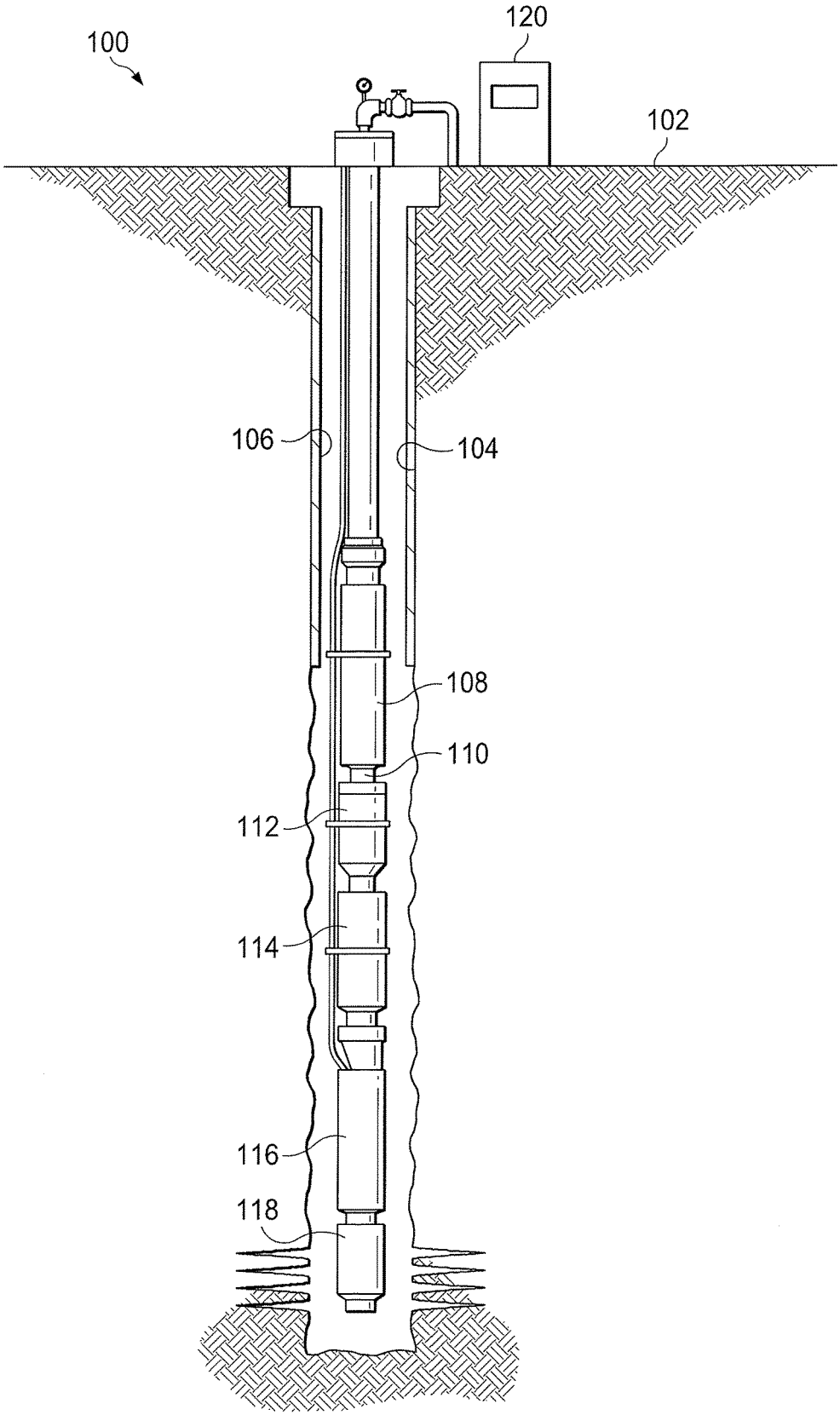
FIG. 1 illustrates an elevation view of an example embodiment of a subterranean operations system including an electrical submersible pump (ESP), in accordance with some embodiments of the present disclosure.

FIG. 1 illustrates an elevation view of an example embodiment of subterranean operations system 100 including ESP 108, in accordance with some embodiments of the present disclosure. In the illustrated embodiment, subterranean operations system 100 may be associated with land-based subterranean operations. However, subterranean operations tools incorporating teachings of the present disclosure may be satisfactorily used with subterranean operations equipment located on offshore platforms, drill ships, semi-submersibles and drilling barges.

Subterranean operations system 100 may include wellbore 104. "Uphole" may be used to refer to a portion of wellbore 104 that is closer to well surface 102 and "downhole" may be used to refer to a portion of wellbore 104 that is further from well surface 102. Wellbore 104 may be defined in part by casing string 106 that may extend from well surface 102 to a selected downhole location. Portions of wellbore 104 that do not include casing string 106 may be described as "open hole."

Various types of hydrocarbons may be pumped from wellbore 104 to well surface 102 through the use of ESP 108. ESP 108 may be a multistage centrifugal pump and may function to transfer pressure to the hydrocarbon fluid and/or another type of liquid to propel the fluid from a reservoir to well surface 102 at a desired pumping rate. ESP 108 may transfer pressure to the fluid by adding kinetic energy to the fluid via centrifugal force and converting the kinetic energy to potential energy in the form of pressure. ESP 108 may have any suitable diameter based on the characteristics of the subterranean operation, such as the wellbore size and the desired pumping flow rate. ESP 108 may include one or more pump stages, depending on the pressure and flow requirements of the particular subterranean operation. Each stage of ESP 108 may include one or more impellers and diffusers as discussed in further detail with respect to FIG. 2.

Shaft 110 may connect the various components of ESP 108 to other components of the subterranean operation such as intake 112, seal chamber 114, motor 116, and sensor 118. Shaft 110 may have a power cable (not expressly shown) connecting motor 116 to controller 120 at well surface 102. Shaft 110 may transmit the rotation of motor 116 to one or more impellers located in ESP 108 and cause the impellers to rotate, as discussed further with reference to FIG. 2.

Intake 112 may allow fluid to enter the bottom of ESP 108 and flow to the first stage of ESP 108. Seal chamber 114 may extend the life of the motor by, for example, absorbing axial thrust produced by ESP 108, dissipating heat created by the thrust produced by ESP 108, protecting oil for motor 116 from contamination, and providing pressure equalization between motor 116 and wellbore 104.

Motor 116 may operate at high rotational speeds, such as 3,500 revolutions per minute and the rotation of motor 116 may cause shaft 110 to rotate. The rotation of shaft 110 may rotate the impellers inside ESP 108 and may cause ESP 108 to pump fluid to well surface 102. Sensor 118 may include one or more sensors used to monitor the operating parameters of ESP 108 and/or conditions in wellbore 104, such as the intake pressure, casing annulus pressure, internal motor temperature, pump discharge pressure and temperature, downhole flow rate, or equipment vibration.

As hydrocarbon fluid travels through ESP 108, the pressure of fluid may generally increase at each stage due to the fluid traveling through the diffuser. The increase in pressure through each stage of ESP 108 results in ESP 108 operating under, and being designed for, downthrust conditions. A downthrust condition may exist when the pressure is higher in a subsequent stage of ESP 108 in the direction of the fluid flow (referred to as a "higher stage") than the pressure in a previous stage of ESP 108 (referred to as a "lower stage"). In some embodiments, a higher stage may be uphole from a lower stage. ESP 108 may contain thrust bearings (not expressly shown) to support the force exerted on the lower stages during downthrust conditions. However, in some circumstances, an upthrust condition may occur. An upthrust condition may exist when the inertial forces of the fluid in ESP 108 toward a higher stage of ESP 108 overcome the downthrust force component. The upthrust condition may force an impeller against a diffuser and may cause damage to the diffuser and/or impeller because ESP 108 may not be designed to endure upthrust conditions and may not have sufficient bearings to support the frictional forces on the components of ESP 108 during upthrust conditions. While ESP 108 may include thrust bearings to reduce friction between the moving components of ESP 108 during downthrust conditions, the thrust bearings may not engage during upthrust conditions and may not reduce friction between the impeller and the diffuser. Additionally, the upthrust condition may cause the impeller and the diffuser to be in direct contact, where the contact may cause abrasive wear as the impeller spins against the diffuser. Therefore, one or more thrust washers may be affixed to the impeller to prevent direct, metal-to-metal contact between the impeller and the diffuser.

Figure 2:
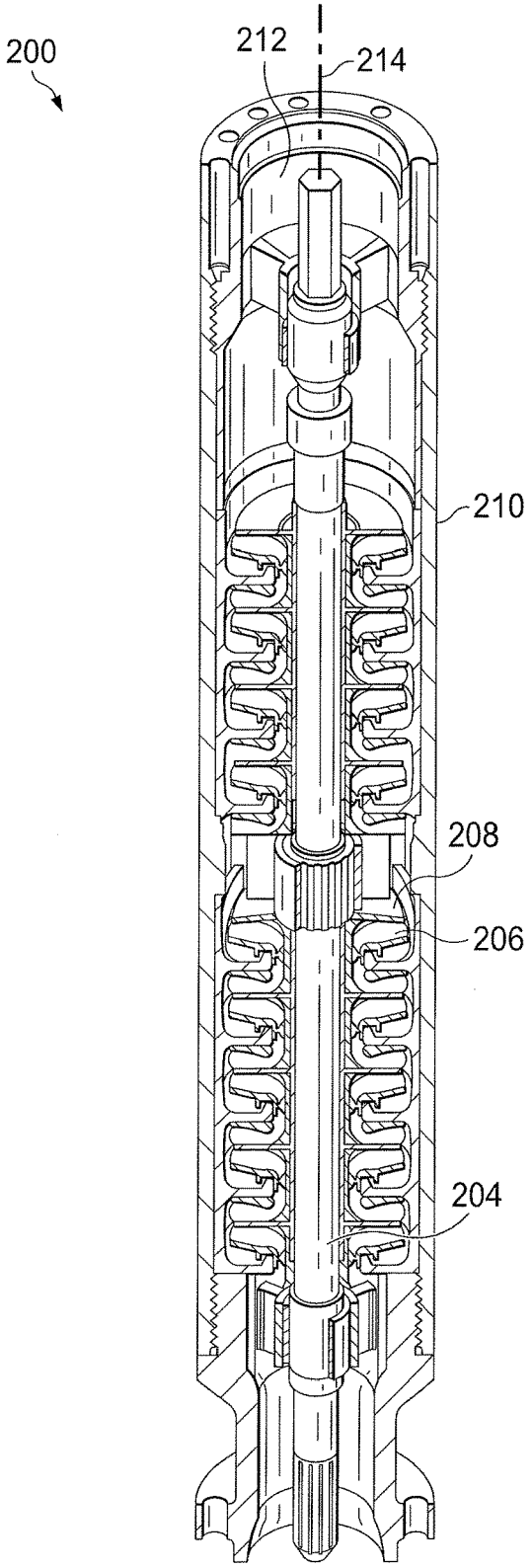
FIG. 2 illustrates a cross-section view of an ESP, in accordance with some embodiments of the present disclosure.

FIG. 2 illustrates a cross-sectional view of ESP 200, in accordance with some embodiments of the present disclosure. In the illustrated embodiment, ESP 200 may include shaft 204, impeller 206, diffuser 208, housing 210, and discharge head 212.

Shaft 204 may be used to transfer rotational energy from a motor, such as motor 116 shown in FIG. 1, to the rotational components of ESP 200, such as impeller 206. Impeller 206 may be used to increase the velocity and kinetic energy of the fluid as the fluid flows through ESP 200. Impeller 206 may rotate about rotational axis 214. The rotation of impeller 206 may cause the hydrocarbon fluid to accelerate outward from shaft 204 and increase the velocity of the fluid inside ESP 200. The increased velocity of the fluid may result in the fluid having an increased kinetic energy.

As the fluid exits impeller 206, the fluid may enter diffuser 208. Diffuser 208 may convert the kinetic energy of the fluid into potential energy by gradually slowing the fluid, which increases the pressure of the fluid according to Bernoulli's principle. The increased pressure of the fluid causes the fluid to rise to the well surface, such as well surface 102 shown in FIG. 1. Each stage of ESP 200 may include an impeller 206 and a diffuser 208. The stages of ESP 200 may be connected in series to achieve a design output pressure of ESP 200. While ESP 200 is shown in FIG. 2 as having more than one stage, ESP 200 may also be a single-stage pump.

After traveling through the stages of ESP 200, the fluid may exit ESP at discharge head 212. In some embodiments, discharge head 212 may be connected to production tubing which may be used to direct the flow of fluid from the wellbore to the well surface. Housing 210 may surround the components of ESP 200 and may align the components of ESP 200.

In some embodiments, there may be open space, or "float space," between impeller 206 and diffuser 208, located above impeller 206. ESP 200 may be designed to operate in a downthrust condition, where the pressure of the fluid in a higher (e.g., uphole) stage of ESP 200 is higher than the pressure of the fluid in a lower (e.g., downhole) stage of ESP 200. In downthrust conditions, impeller 206 and diffuser 208 are not in contact. However, in some circumstances, ESP 200 may experience an upthrust condition when the inertial forces of the fluid in ESP 200 toward a higher stage of ESP 200 overcome the downthrust force component. During an upthrust condition, impeller 206 may rise up into the float space and come in contact with diffuser 208. Upthrust conditions may be damaging to impeller 206 and diffuser 208 due to the friction caused by the direct contact between impeller 206 and diffuser 208. The frictional wear may decrease the lifespan of impeller 206 and/or diffuser 208.

Figure 3:
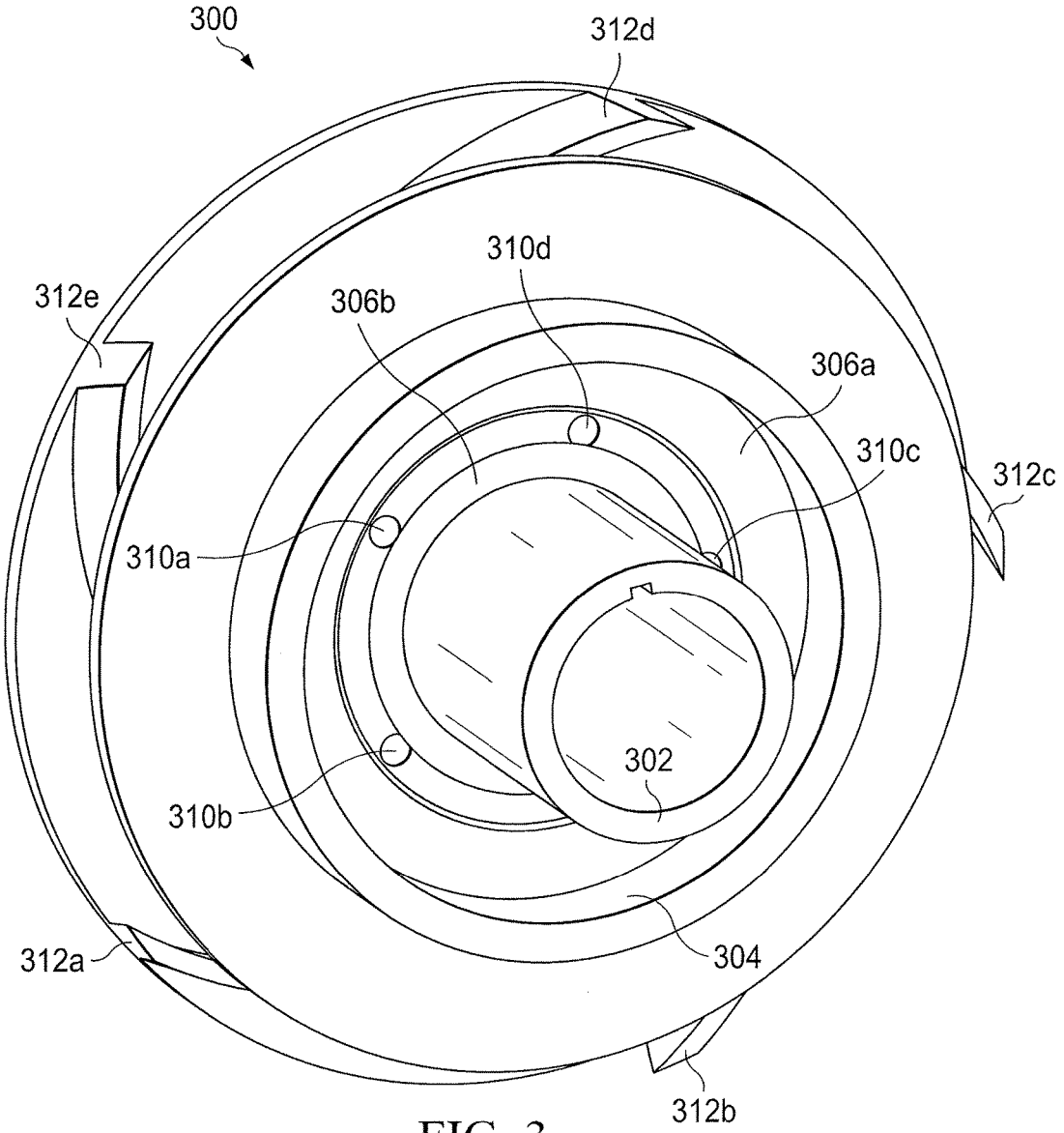
FIG. 3 illustrates a perspective view of an impeller including an impeller shaft hub, thrust washer components, balance holes, and blades, in accordance with some embodiments of the present disclosure.

To prevent damage to impeller 206 and/or diffuser 208 during an upthrust condition, one or more thrust washers (as shown in FIG. 3) may be placed between impeller 206 and diffuser 208. The thrust washer may protect impeller 206 and diffuser 208 and prevent direct contact between impeller 206 and diffuser 208. The thrust washer may also create an increased seal between impeller 206 and diffuser 208, as compared to direct contact between impeller 206 and diffuser 208. The seal created by the thrust washer may increase the pressure of the fluid in diffuser 208 and may force impeller 206 away from diffuser 208. The pressure increase may return ESP 200 to a downthrust condition.

FIG. 3 illustrates an isometric view of impeller 300 including impeller shaft hub 302, balance ring 304, thrust washer 306 (shown by components 306*a* and 306*b*), balance holes 310*a*-310*d* ("balance holes 310"), and blades 312*a*-312*e* ("blades 312"), in accordance with some embodiments of the present disclosure. Impeller 300 may be a component of a stage of an ESP, such as ESP 108 in FIG. 1, and may rotate about hub 302 when driven by an electric motor (not expressly shown). Hub 302 may be located in the center of impeller 300 and may be aligned with the axis of rotation of impeller 300, such as rotational axis 214 shown in FIG. 2. Impeller 300 may rotate at speeds exceeding approximately 3,500 revolutions per minute. The rotation of impeller 300 may cause blades 312 to cause the hydrocarbon fluid to accelerate as the fluid is directed towards the walls of the pump thus increasing the kinetic energy of the fluid. Impeller 300 may be manufactured of a cast iron alloy where the alloying element may be any element providing suitable characteristics, such as nickel, chromium, copper, carbon, or silicon. The alloying element may be selected to provide corrosion, oxidation, and/or heat resistance, as required by the subterranean operation and wellbore environment.

Some subterranean operations, the pump may have a larger flow rate than the designed flow rate, which may create an undesirable upthrust condition. Therefore, balance holes 310 may provide pressure balance between the stages of the pump by allowing the fluid to escape the pump stage. While impeller 300 is shown in FIG. 3 as having five balance holes 310 and five blades 312, impeller 300 may have any number of balance holes 310 and blades 312.

Thrust washer 306 may be attached to impeller 300 via a press fit that fastens impeller 300 and thrust washer 306 together through friction between impeller 300 and thrust washer 306. For example, thrust washer component 306*a* may be pressed against balance ring 304 and thrust washer component 306*b* may be pressed against hub 302.

In some embodiments, thrust washer 306 may include a phenolic resin. In other embodiments, thrust washer 306 may include a hard, anti-abrasive material, such as a ceramic, a carbide, a composite material, or a composite material embedded with a lubricant. In embodiments where thrust washer 306 includes a hard, anti-abrasive material, the thrust washer may be capable of enduring a greater amount of frictional force than a thrust washer including a phenolic resin.

The dimensions of thrust washer 306 may be bound by various features of impeller 300. For example, an outer diameter of thrust washer 306 may be less than or equal to the inner diameter of the balance ring and an inner diameter of thrust washer 306 may be greater than or equal to the outer diameter of hub 302. In addition, thrust washer 306 may be formed to allow fluid and/or gas to flow through balance holes 310. For example, in the embodiment illustrated in FIG. 3, thrust washer 306 is shown as having two concentric components, components 306*a* and 306*b*. The outer and inner diameters of component 306*a* may be bound by balance ring 304 and balance holes 310, respectively, and the outer and inner diameter of component 306*b* may be bound by balance holes 310 and hub 302, respectively. Components 306*a* and 306*b* may be designed to span the available surface area between balance ring 304 and hub 302, with the exception of the area surrounding balance holes 310, thus not blocking the flow of fluid and/or gas through balance holes 310. In other embodiments, thrust washer 306 may include more than two concentric components occupying the same areas of impeller 300 as the illustrated components 306*a* and 306*b*.

Figure 4A:
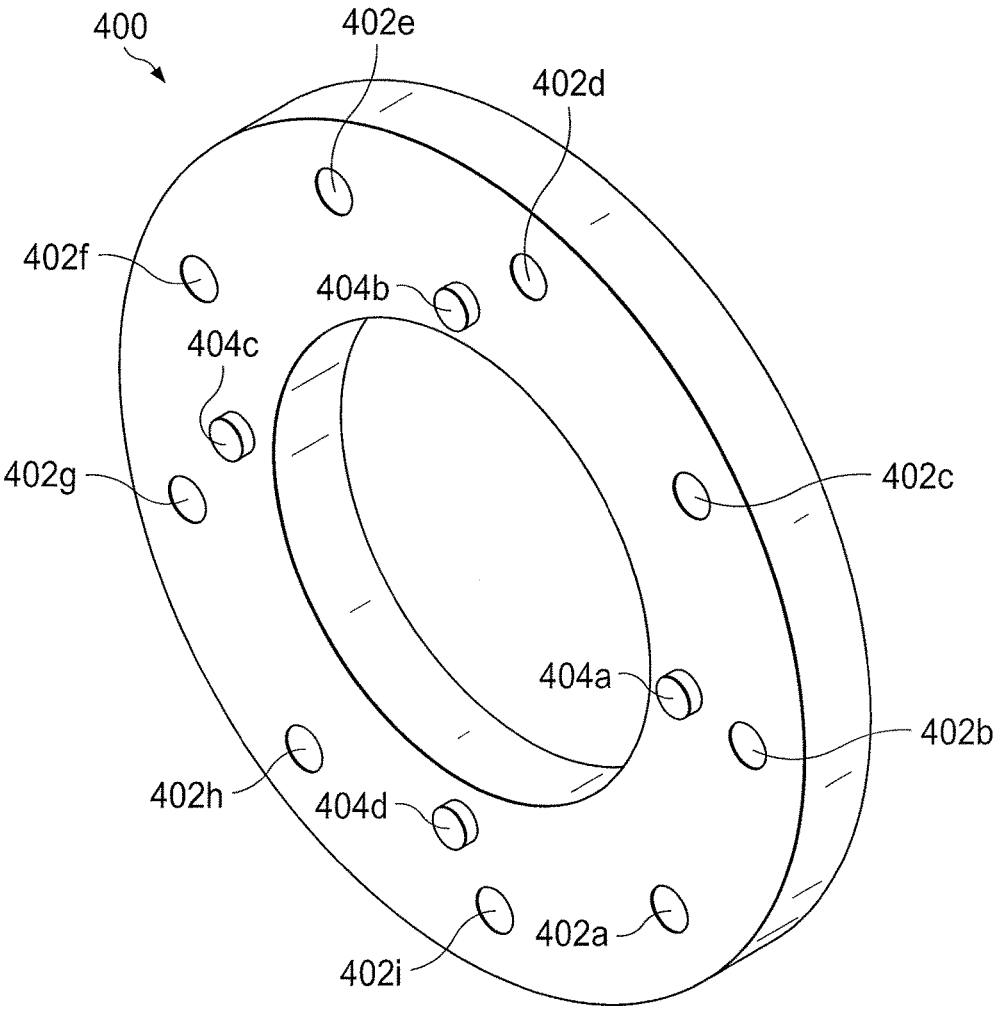
FIG. 4A illustrates a perspective view of a thrust washer including balance hole cutouts and anti-rotational pegs, in accordance with some embodiments of the present disclosure.
Figure 4B:
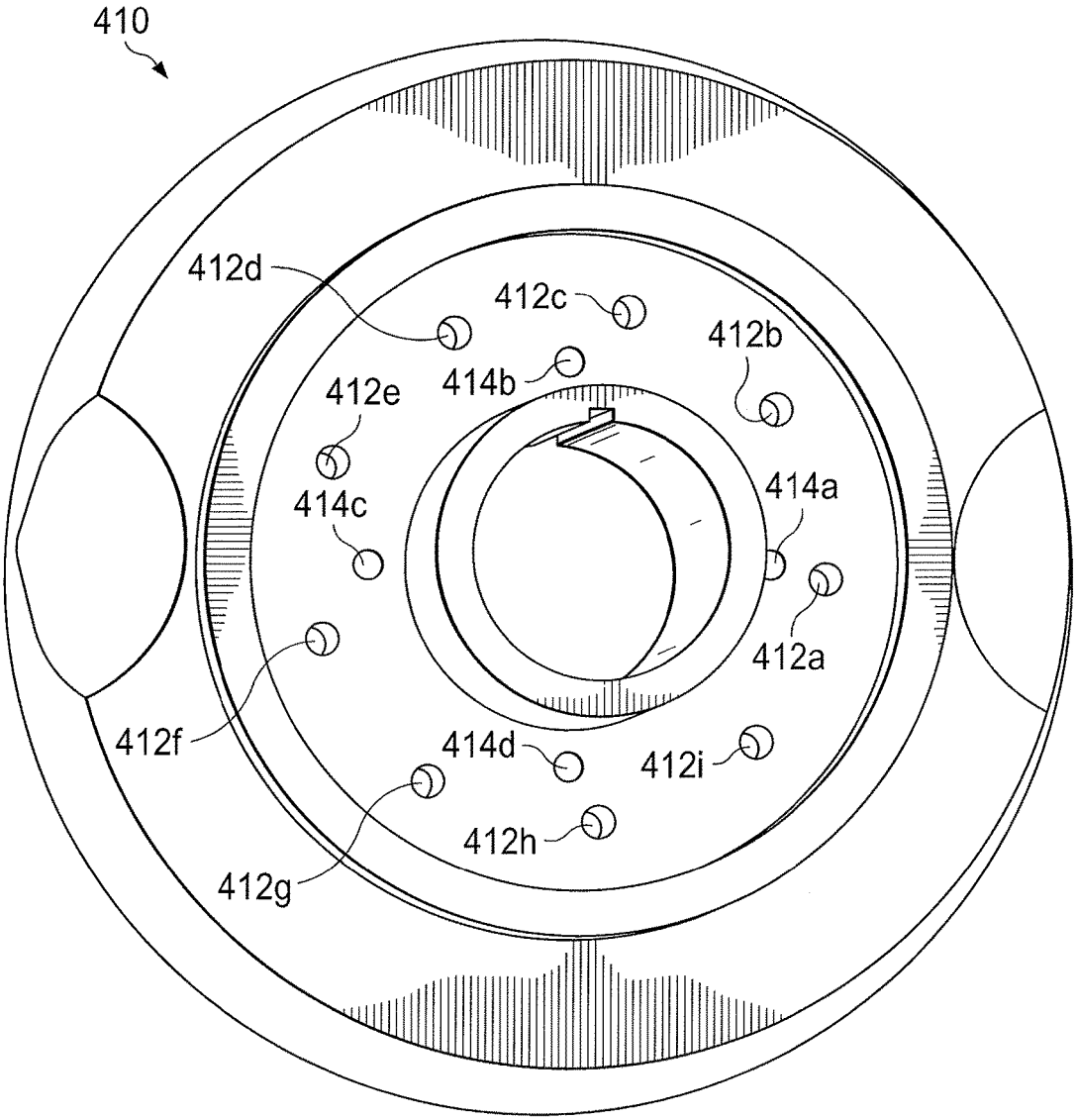
FIG. 4B illustrates a perspective view of an impeller including anti-rotational notches, in accordance with some embodiments of the present disclosure.

In another embodiment, the thrust washer may be a single component. FIG. 4A illustrates a perspective view of thrust washer 400 including balance hole cutouts 402*a*-402*i* ("balance hole cutouts 402") and anti-rotational pegs 404*a*-404*d* ("anti-rotational pegs 404"), in accordance with some embodiments of the present disclosure. FIG. 4B illustrates a perspective view of impeller 410 including balance holes 412*a*-412*i* ("balance holes 412") and anti-rotational notches 412*a*-412*d* ("anti-rotational notches 412"), in accordance with some embodiments of the present disclosure. Thrust washer 400 may have an inner diameter bound by the outer diameter of hub 416 and an outer diameter bound by the inner diameter of balance ring 418 and may have balance hole cutouts 402 corresponding to balance holes 412. Thrust washer 400 may be attached to impeller 410 in such a manner that balance hole cutouts 402 line up with balance holes 412 to enable flow of fluid and/or gas through balance holes 412 in order to provide a pressure balance function without interference from thrust washer 400. Balance holes 412 may provide pressure balance by allowing the fluid to escape the ESP through impeller 410. In such an embodiment, thrust washer 400 may provide additional surface area to provide additional protection against frictional wear between impeller 410 and a diffuser during upthrust conditions due to the additional surface area of thrust washer 400 located in the available space on impeller 410 between balance holes 412, as compared to concentric components 306*a* and 306*b* shown in FIG. 3.

Impeller 410 may rotate about a shaft of the ESP. In some situations, thrust washer 400 may rotate at a rotational speed different from impeller 410. The difference in the rotational speed of thrust washer 400 and impeller 410 may cause thrust washer 400 to wear at the points where thrust washer 400 is in contact with impeller 410 which may cause thrust washer 400 to have a shorter lifespan. Thrust washer 400 may include anti-rotational pegs 404 which may be inserted into anti-rotational notches 414 on impeller 410. Anti-rotational pegs 404 may prevent thrust washer 400 from rotating relative to impeller 410 and may extend the lifespan of thrust washer 400. While thrust washer 400 is shown as a single component thrust washer, a thrust washer 400 with more than one component may also include anti-rotational pegs 404 on each component of thrust washer 400 to prevent relative rotation between the thrust washer component and impeller 410.

Figure 5:
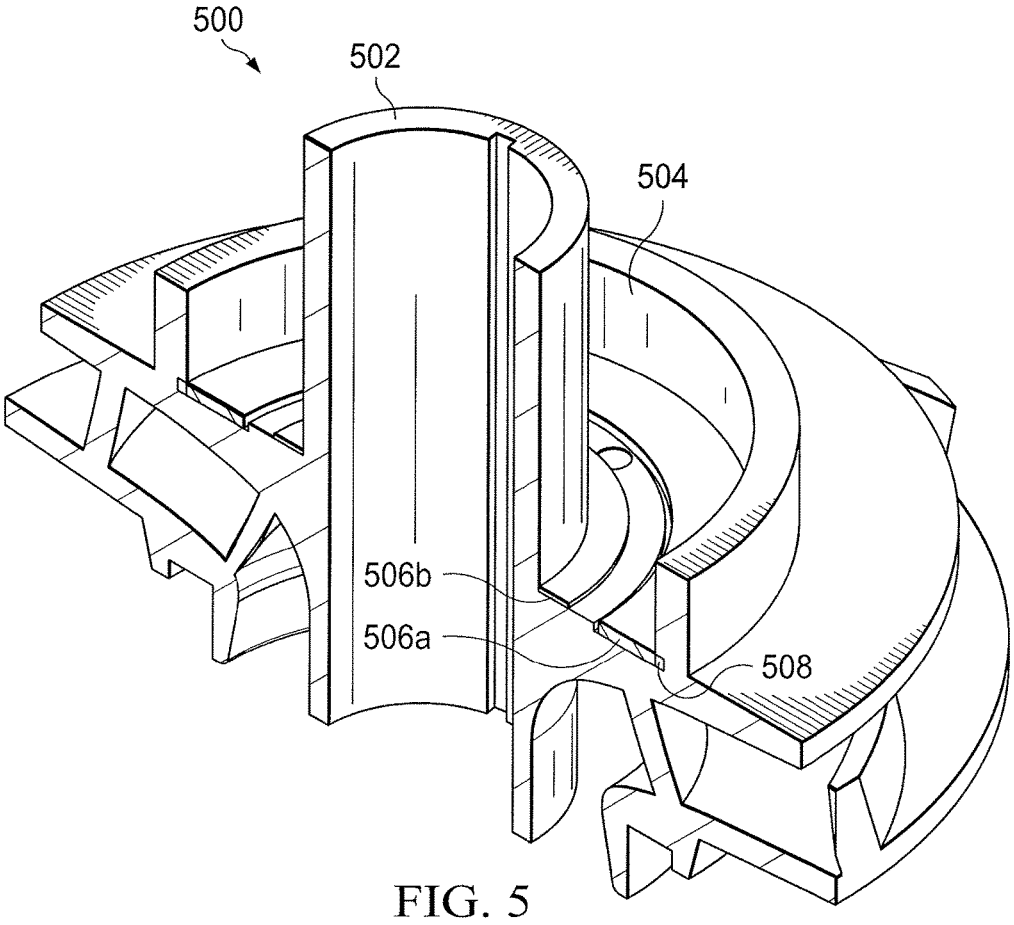
FIG. 5 illustrates a cross-section view of an anti-rotational impeller with a thrust washer groove inside of a balance ring, in accordance with some embodiments of the present disclosure.

FIG. 5 illustrates a cross-section view of anti-rotational impeller 500 with thrust washer groove 508 inside of balance ring 504, in accordance with some embodiments of the present disclosure. In some embodiments, impeller 500 may have groove 508 formed in balance ring 504. Thrust washer 506 may be pressed into groove 508 to hold thrust washer 506 in place. Groove 508 may hold thrust washer 506 stationary with respect to impeller 500 while impeller 500 is rotating and may prevent thrust washer 506 from rotating at a speed different from the rotational speed of impeller 500. Thrust washer 506 may not wear at the points in contact with impeller 500 due to the lack of relative motion between thrust washer 506 and impeller 500 as described in more detail with respect to FIGS. 4A and 4B. While thrust washer 506 is shown in FIG. 5 as having two thrust washer components 506*a* and 506*b*, a single component thrust washer, such as thrust washer 400 shown in FIG. 4A, may be used with thrust washer groove 508.

Figure 6:
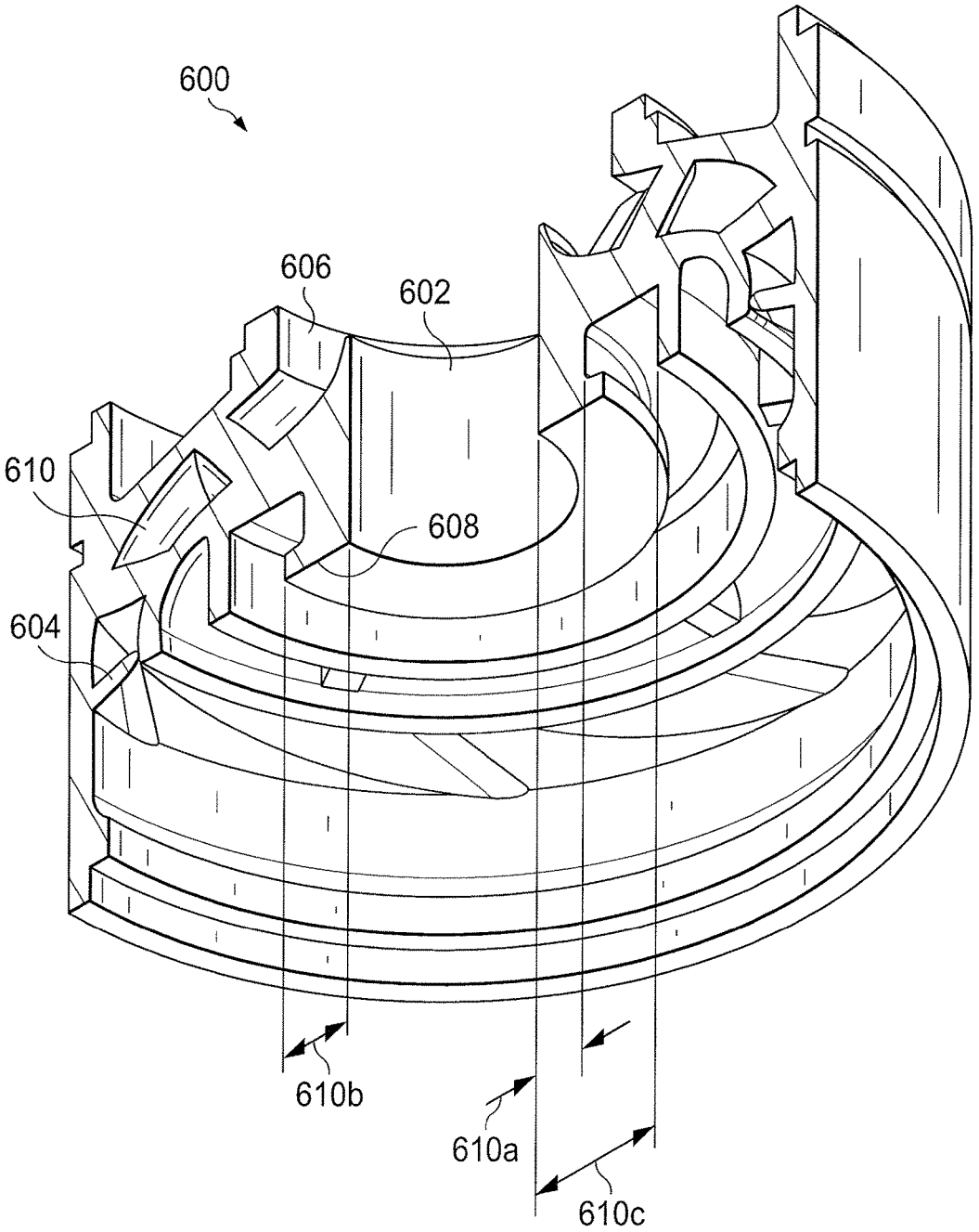
FIG. 6 illustrates a cross-section view of a diffuser, in accordance with some embodiments of the present disclosure.

FIG. 6 illustrates a cross-section view of diffuser 600, in accordance with some embodiments of the present disclosure. Diffuser 600 may be a component of a stage of an ESP, such as ESP 108 shown in FIG. 1, and may be used to convert the kinetic energy (e.g., velocity) of the hydrocarbon fluid into potential energy (e.g., pressure) by gradually slowing the fluid, which increases the pressure of the fluid. The increased pressure of the fluid may cause the fluid to rise to the surface, such as well surface 102 shown in FIG. 1. Diffuser 600 may increase the pressure of the hydrocarbon fluid by providing a continually increasing flow area as the fluid passes through diffuser 600. For example, fluid flow channel 602 has a smaller flow area at entry 604 and a larger flow area at exit 606. As the fluid travels from the smaller flow area of entry 604 to the larger flow area of exit 606, the fluid may slow and the pressure of the fluid may increase according to Bernoulli's principle.

Surface 608 of diffuser 600 may contact a thrust washer, such as thrust washer 306 shown in FIG. 3, during upthrust conditions. Surface 608 may be attached to the main body of diffuser 600 by leg 610. Surface 608 may be attached to leg 610 to maximize the surface area of diffuser 600 in contact with the thrust washer during an upthrust condition. For example, surface 608 may have a larger surface area exposed to the thrust washer than the surface area of leg 610 that may be exposed to the thrust washer in the absence of surface 608. Surface 608 may be circular with an inside radius and an outside radius. The surface area of surface 608 is determined by $$\text{Area}=\pi(R_1^2-R_2^2)$$

where $R_1$=the outer radius of surface 608; and $R_2$=the inner radius of surface 608.

The inner radius of surface 608 may be defined based on the outer diameter of the impeller shaft hub, such as hub 302 shown in FIG. 3. The minimum outer radius of surface 608 may be defined by radius 610*a*, which is equal to the outer diameter of leg 610, and the maximum outer radius of surface 608 may be defined by radius 610*c*. In some embodiments, radius 610*c* may be equal to the inner radius of a balance ring of an impeller located adjacent to diffuser 600. In other embodiments, radius 610*c* may be equal to the outer radius of a thrust washer located on an impeller located adjacent to diffuser 600 to which surface 608 may be in contact during an upthrust condition. Surface 608 may have an outer radius of any distance between radius 610*a* and radius 610*c*. For example, as shown in FIG. 6, surface 608 has an outer radius equal to radius 610*b*. The greater the surface area of surface 608, the greater the contact area between surface 608 and the thrust washer. A greater contact area between surface 608 and the thrust washer may distribute the frictional force across a larger area of the thrust washer and reduce the stress on the thrust washer, resulting in less wear of the thrust washer during an upthrust condition.

Surface 608 may create a seal with the thrust washer that increases the pressure through diffuser 600 and creates a downward force on the impeller. The increased pressure may assist with returning the pump to downthrust conditions more quickly than a surface that does not create a seal with the thrust washer.

As discussed with reference to FIG. 3, the thrust washer may include a phenolic resin or a hard, anti-abrasive material, such as a ceramic, a carbide, a composite material, or a composite material embedded with a lubricant. In embodiments where the thrust washer includes phenolic resin, diffuser 600 may be manufactured of a cast iron alloy where the alloying element may be any element providing suitable characteristics, such as nickel, chromium, copper, carbon, or silicon. The alloying element may be selected to provide corrosion, oxidation, and/or heat resistance, as required by the subterranean operation and wellbore environment. In embodiments where the thrust washer includes a hard, anti-abrasive material, diffuser 600 may be manufactured of a cast iron alloy where surface 608 is coated with a hard coating. The hard coating may be the same material as the thrust washer material, such as a ceramic, a carbide, a composite material, or a composite material with an embedded lubricant, or the hard coating may be a material that is compatible with the thrust washer material. The hard coating may be compatible with the thrust washer material if the hard coating has a similar or greater hardness when compared to the thrust washer material. Surface 608 may be coated with a hard coating in order to provide similar hardness to match the hardness of the thrust washer to prevent surface 608 from eroding due to the contact with a harder thrust washer.

Figure 7A:
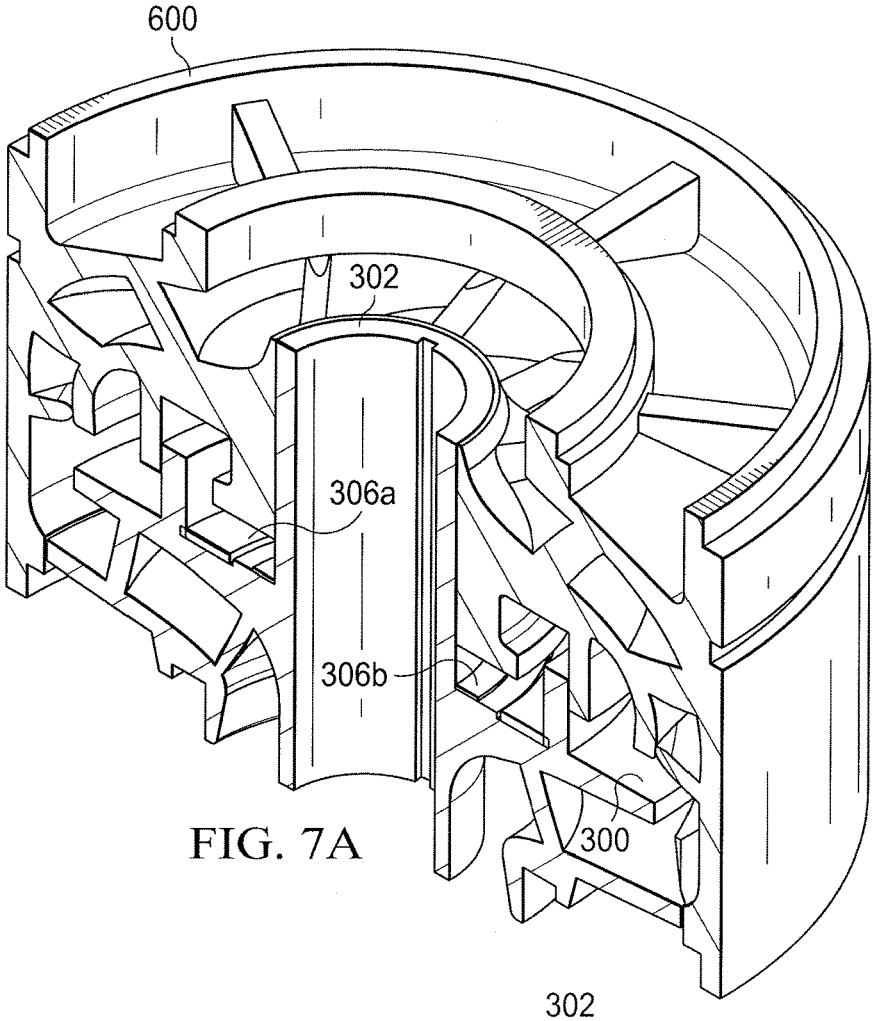
FIG. 7A illustrates an exploded cross-section view of an impeller and a diffuser and FIG. 7B illustrates a cross-section view of an impeller and a diffuser during an upthrust condition, in accordance with some embodiments of the present disclosure.
Figure 7B:
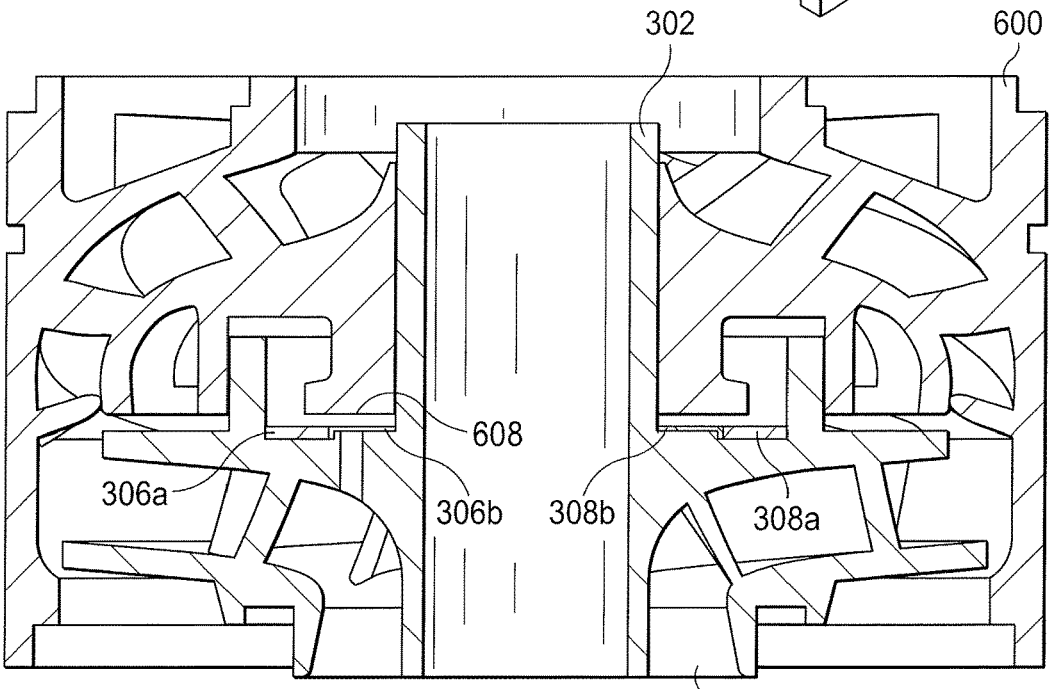

FIG. 7A illustrates an exploded cross-section view of impeller 300 and diffuser 600 and FIG. 7B illustrates a cross-section view of impeller 300 and diffuser 600 during an upthrust condition, in accordance with some embodiments of the present disclosure. In some embodiments, an ESP may have several stages including one or more diffusers 600. As hydrocarbon fluid travels through the ESP, the pressure of the fluid may generally increase in each stage due to the fluid traveling through diffuser 600. The increase in pressure may create a downthrust condition, where the pressure may be higher in a higher (e.g., uphole) stage than the pressure in a lower (e.g., downhole) stage. ESPs may be designed to operate under downthrust conditions. However, an upthrust condition, where the inertial forces of the fluid in the pump toward a higher stage of the pump overcome the downthrust force component, may occur in certain situations, such as when the flow rate of fluid through the pump is higher than the designed flow rate. The upthrust condition may force impeller 300 against diffuser 600. An upthrust condition may cause damage to diffuser 600 and/or impeller 300 because the ESP may not be designed to operate during upthrust conditions due to the damage caused by metal to metal contact between diffuser 600 and impeller 300. Direct contact between diffuser 600 and impeller 300 may be harmful because direct contact between the two metal components may cause abrasive wear as impeller 300 spins against diffuser 600. Under normal operating conditions (e.g., downthrust conditions), the ESP has thrust bearings to bear the downthrust load. However, in upthrust conditions, there may not be thrust bearings located above impeller 30 to bear the upthrust load and impeller 300 and diffuser 600 may be in direct contact. Therefore, one or more thrust washers 306 may be attached to impeller 300 to prevent direct, metal-to-metal contact between impeller 300 and diffuser 600.

During a downthrust condition, impeller 300 may be spaced away from diffuser 600 creating a float space. However, during an upthrust condition, impeller 300 may be forced up into the float space and may be in contact with diffuser 600, as shown in FIG. 7B. When impeller 300 and diffuser 600 are in contact, thrust washer 306, affixed to impeller 300, may be in contact with diffuser 600 at surface 608.

The thickness of thrust washer 306 may be determined based on the amount of float space between impeller 300 and diffuser 600 and the proportions of impeller 300. For example, the amount of float space may be between approximately 0.1-inches and approximately 0.25-inches and may vary based on the size of impeller 300. In some embodiments, thrust washer 306 may have a thickness of approximately twenty percent of the float distance between impeller 300 and diffuser 600. In other embodiments, thrust washer 306 may have varying thicknesses across its diameter. For example, in some embodiments component 306*b* may be thicker than component 306*a* to provide the initial contact with diffuser 600. In other embodiments, component 306*a* may be thicker than component 306*b*. When component 306*b* provides initial contact with diffuser 600, component 306*b* may wear a greater amount than component 306*a* due to the greater frictional forces on component 306*b* during the initial contact. As component 306*b* wears and becomes thinner, components 306*a* and 306*b* may contact diffuser 600 simultaneously when components 306*a* and 306*b* are approximately the same thickness. In an embodiment where thrust washer 306 is a single component, thrust washer 306 may have varying thicknesses across its diameter and the thicker areas of thrust washer 306 may provide initial contact with diffuser 600.

In some embodiments, thrust washer component 306*a* may be affixed to impeller 300 on surface 308*a* and thrust washer component 306*b* may be affixed to impeller 300 on surface 308*b*. Balance ring 304 may also be affixed to impeller 30 on surface 308*b*. Surface 308*b* may be further from the main body of impeller 300 than surface 308*a* and thrust washer component 306*b* may sit further away from the main body of impeller 300 than thrust washer component 306*a*. Thrust washer component 306*b* may contact diffuser 600 before thrust washer component 306*a* and thrust washer component 306*b* may absorb more of the initial force of the upthrust condition. Therefore, thrust washer component 306*b* may wear more quickly than thrust washer component 306*a* for a period of time and extend the life of thrust washer component 306*a*. When thrust washer component 306*b* wears to a thickness where thrust washer component 306*b* is the same distance from the main body of impeller 300 as thrust washer component 306*a*, both components 306*a* and 306*b* may contact diffuser 600 virtually simultaneously and may wear at a similar rate.

During an upthrust condition, when impeller 300 is in contact with diffuser 600, thrust washer 306 may contact diffuser 600 at surface 608. Impeller 300 may continue to rotate while diffuser 600 is stationary. The rotation of impeller 300 may cause thrust washer 306 to wear at the points where thrust washer 306 is in contact with the stationary diffuser. In some situations, thrust washer 306 may rotate at a rotational speed different from impeller 300 due to the friction between thrust washer 306 and the diffuser. The difference in the rotational speed of thrust washer 306 and impeller 300 may cause thrust washer 306 to wear at the points where thrust washer 306 is in contact with impeller 300. When thrust washer 306 wears from both sides (the side in contact with the diffuser and the side in contact with impeller 300), thrust washer 306 may have a shorter lifespan. Therefore, thrust washer 306 may have anti-rotational features, such as anti-rotational pegs 404 and anti-rotational notches 414 shown in FIGS. 4A and 4B and groove 508 shown in FIG. 5.

Embodiments disclosed herein include:

A. A multi-stage electrical submersible pump that includes a shaft, a motor communicatively coupled to the shaft and operable to rotate the shaft, an intake operable to direct fluid flow into the multi-stage electrical submersible pump, an impeller coupled to the shaft including a balance ring, a balance hole, and a hub, a diffuser disposed adjacent to the impeller, a thrust washer coupled to the impeller located between the balance ring and the hub without blocking the balance hole to allow fluid flow through the impeller and the diffuser, and a discharge operable to direct fluid flow out of the multi-stage electrical submersible pump.

B. A system for distributing force in a multi-stage pump stack that includes a shaft, an impeller coupled to the shaft including a balance ring, a balance hole, and a hub, a diffuser disposed adjacent to the impeller, and a thrust washer coupled to the impeller. The thrust washer is located between the balance ring and the hub without blocking the balance hole to allow fluid flow through the impeller and the diffuser.

C. An impeller in a multi-stage pump stack, the impeller that includes a surface, a balance ring attached on the surface, a hub located in the center of the impeller and aligned with an axis of rotation of the impeller, a balance hole cut into the surface between the balance ring and the hub, and a thrust washer affixed to the impeller on the surface and located between the balance ring and the hub without blocking the balance hole to allow fluid flow through the impeller.

Each of embodiments A, B, and C may have one or more of the following additional elements in any combination: Element 1: wherein the diffuser includes a thrust washer contact surface having a surface area greater than a surface area of a portion of the diffuser that connects the surface to the diffuser. Element 2: wherein the thrust washer includes at least two concentric thrust washer components. Element 3: wherein a height of at least one of the at least two concentric thrust washer components is different from a height of another of the at least two concentric thrust washer components. Element 4: further comprising an anti-rotational notch in the impeller and an anti-rotational peg affixed to the thrust washer where the anti-rotational peg inserted in the anti-rotational notch. Element 5: wherein the balance ring includes a groove in which the thrust washer is inserted. Element 6: wherein the thickness of the thrust washer is variable across the diameter of the thrust washer. Element 7: wherein the thrust washer prevents direct contact between the impeller and the diffuser. Element 8: wherein the thrust washer includes a hard, anti-abrasive material and a surface of the diffuser where the diffuser contacts the thrust washer is coated with a hard, anti-abrasive material.

Although the present disclosure and its advantages have been described in detail, it should be understood that various changes, substitutions and alterations can be made herein without departing from the spirit and scope of the disclosure as defined by the following claims. For example, while the embodiment discussed describes a thrust washer made of two components, the thrust washer may be made of any number of components. Additionally the thrust washer may be made of any suitable material having sufficient bearing function to lubricate and prevent heat build-up.

What is claimed is:

1. A multi-stage electrical submersible pump comprising:
a shaft;
a motor communicatively coupled to the shaft, the motor operable to rotate the shaft;
an intake operable to direct fluid flow into the multi-stage electrical submersible pump;
an impeller coupled to the shaft, the impeller including a balance ring, a balance hole, and a hub;
a diffuser disposed adjacent to the impeller;
a thrust washer coupled to the impeller, the thrust washer spanning a surface of the impeller from the balance ring to the hub without blocking the balance hole to allow fluid flow through the impeller and the diffuser; and
a discharge operable to direct fluid flow out of the multi-stage electrical submersible pump.

2. The multi-stage electrical submersible pump of claim 1, wherein the diffuser includes a thrust washer contact surface, the surface having a surface area greater than a surface area of a portion of the diffuser that connects the surface to the diffuser.

3. The multi-stage electrical submersible pump of claim 1, wherein the thrust washer includes at least two concentric thrust washer components.

4. The multi-stage electrical submersible pump of claim 3, wherein a height of at least one of the at least two concentric thrust washer components is different from a height of another of the at least two concentric thrust washer components.

5. The multi-stage electrical submersible pump of claim 1, further comprising:
an anti-rotational notch in the impeller; and
an anti-rotational peg affixed to the thrust washer, the anti-rotational peg inserted in the anti-rotational notch.

6. The multi-stage electrical submersible pump of claim 1, wherein the balance ring includes a groove in which the thrust washer is inserted.

7. The multi-stage electrical submersible pump of claim 1, wherein the thickness of the thrust washer varies across the diameter of the thrust washer.

8. The multi-stage electrical submersible pump of claim 1, wherein the thrust washer prevents direct contact between the impeller and the diffuser.

9. The multi-stage electrical submersible pump of claim 1, wherein:
the thrust washer includes a hard, anti-abrasive material; and
a surface of the diffuser where the diffuser contacts the thrust washer is coated with a hard, anti-abrasive material.

10. A system for distributing force in a multi-stage pump stack comprising:
a shaft;
an impeller coupled to the shaft, the impeller including a balance ring, a balance hole, and a hub;
a diffuser disposed adjacent to the impeller; and
a thrust washer coupled to the impeller, the thrust washer spanning a surface of the impeller from the balance ring to the hub without blocking the balance hole to allow fluid flow through the impeller and the diffuser.

11. The system of claim 10, wherein the diffuser includes a thrust washer contact surface, the surface having a surface area greater than a surface area of a portion of the diffuser that connects the surface to the diffuser.

12. The system of claim 10, wherein the thrust washer includes at least two concentric thrust washer components.

13. The system of claim 12, wherein a height of at least one of the at least two concentric thrust washer components is different from a height of another of the at least two concentric thrust washer components.

14. The system of claim 10, further comprising:
an anti-rotational notch in the impeller; and
an anti-rotational peg affixed to the thrust washer, the anti-rotational peg inserted in the anti-rotational notch.

15. The system of claim 10, wherein the balance ring contains a groove in which the thrust washer is inserted.

16. The system of claim 10, wherein the thickness of the thrust washer varies across the diameter of the thrust washer.

17. The system of claim 10, wherein the thrust washer prevents direct contact between the impeller and the diffuser.

18. The system of claim 10, wherein:
the thrust washer includes a hard, anti-abrasive material; and
a surface of the diffuser where the diffuser contacts the thrust washer is coated with a hard, anti-abrasive material.

19. An impeller in a multi-stage pump stack, the impeller comprising:
a surface;
a balance ring attached on the surface;
a hub located in the center of the impeller and aligned with an axis of rotation of the impeller;
a balance hole cut into the surface between the balance ring and the hub; and
a thrust washer affixed to the impeller on the surface, the thrust washer spanning a surface of the impeller from the balance ring to the hub without blocking the balance hole to allow fluid flow through the impeller.

20. The impeller of claim 19, wherein the thrust washer includes at least two concentric thrust washer components.

21. The impeller of claim 20, wherein a height of at least one of the at least two concentric thrust washer components is different from a height of another of the at least two concentric thrust washer components.

22. The impeller of claim 19, further comprising:
an anti-rotational notch in the impeller; and
an anti-rotational peg affixed to the thrust washer, the anti-rotational peg inserted in the anti-rotational notch.

23. The impeller of claim 19, wherein the balance ring includes a groove in which the thrust washer is inserted.

24. The impeller of claim 19, wherein the thickness of the thrust washer varies across the diameter of the thrust washer.

25. The impeller of claim 19, wherein the thrust washer prevents direct contact between the impeller and a diffuser.

26. The impeller of claim 19, wherein the thrust washer includes a hard, anti-abrasive material.

* * * * *